US006557361B1

(12) United States Patent
Howard

(10) Patent No.: US 6,557,361 B1
(45) Date of Patent: May 6, 2003

(54) METHOD FOR OPERATING A CASCADE REFRIGERATION SYSTEM

(75) Inventor: Henry Edward Howard, Grand Island, NY (US)

(73) Assignee: Praxair Technology Inc., Danbury, CT (US)

( * ) Notice: Subject to any disclaimer, the term of this patent is extended or adjusted under 35 U.S.C. 154(b) by 0 days.

(21) Appl. No.: 10/105,344

(22) Filed: Mar. 26, 2002

(51) Int. Cl.[7] ..... F25B 7/00
(52) U.S. Cl. ..... 62/175; 62/228.3
(58) Field of Search ..... 62/79, 175, 335

(56) References Cited

U.S. PATENT DOCUMENTS

| | | | | | |
|---|---|---|---|---|---|
| 2,022,764 | A | | 12/1935 | Gibson et al. | 62/4 |
| 2,434,221 | A | | 1/1948 | Newton et al. | 62/4 |
| 4,344,296 | A | | 8/1982 | Staples et al. | 62/175 |
| 4,757,694 | A | * | 7/1988 | Espinosa | 62/175 |
| 5,042,262 | A | | 8/1991 | Gyger et al. | 62/64 |
| 5,524,442 | A | | 6/1996 | Bergman, Jr. et al. | 62/86 |
| 5,687,579 | A | * | 11/1997 | Vaynberg | 62/175 |
| 5,729,993 | A | * | 3/1998 | Boiarski et al. | 62/175 |
| 6,076,372 | A | | 6/2000 | Acharya et al. | 62/606 |
| 6,105,388 | A | | 8/2000 | Acharya et al. | 62/612 |
| 6,116,035 | A | * | 9/2000 | Tanaka et al. | 62/175 |
| 6,176,102 | B1 | | 1/2001 | Novak et al. | 62/612 |
| 6,250,096 | B1 | | 6/2001 | Bonaquist et al. | 62/401 |
| 6,324,856 | B1 | * | 12/2001 | Weng | 62/175 |
| 6,327,865 | B1 | | 12/2001 | Bonaquist et al. | 62/79 |
| 6,327,866 | B1 | | 12/2001 | Novak et al. | 62/114 |
| 6,405,554 | B1 | * | 6/2002 | Kawakatu et al. | 62/335 |
| 6,460,355 | B1 | * | 10/2002 | Trieskey | 62/175 |

* cited by examiner

*Primary Examiner*—William E. Tapolcai
*Assistant Examiner*—Mohammad M. Ali
(74) *Attorney, Agent, or Firm*—Stanley Ktorides

(57) ABSTRACT

A cascade refrigeration system wherein the inlet and outlet pressures and the power consumption of the compressor of the higher temperature refrigeration circuit, and the inlet and outlet pressures and the power consumption of the compressor of the lower temperature refrigeration circuit are ascertained and used to calculate more efficient operating pressures, and the operation of the compressors is adjusted to adjust the pressures of the incoming refrigerants to the cascade heat exchanger toward the more efficient operating pressures.

15 Claims, 3 Drawing Sheets

METHOD FOR OPERATING A CASCADE REFRIGERATION SYSTEM

TECHNICAL FIELD

This invention relates to cascade refrigeration systems wherein a first refrigeration circuit develops higher temperature refrigeration, which is provided to a refrigerant in a second refrigeration circuit, which then develops lower temperature refrigeration which is used to refrigerate a heat or refrigeration load such as is required in a food freezing operation.

BACKGROUND ART

The design and operation of virtually all cascade refrigeration systems pose an inherent optimization problem. In general, the evaporator temperature, Te, and load, $Q_e$, on the low temperature or secondary circuit are known. The condensing temperature and ambient utility for the high temperature or primary circuit define the high side pressure of the primary refrigerant circuit. The intermediate operating temperature of the cascade condenser or refrigerant-refrigerant heat exchanger must subsequently be determined. Minimum system power consumption is achieved only when this intermediate temperature is appropriately identified. The subject optimization needs to be addressed at process design and actual operation. During actual process operation most systems may deviate substantially from the design load and conditions. In such situations the power consumption can be 5–10% higher than necessary. Most cascade control systems cannot readily extract this additional process efficiency. If and when online optimization is addressed, it is often through rudimentary techniques such as manual trial and error or simple heuristics.

Accordingly, it is an object of this invention to provide a method for operating a cascade refrigeration system which enables the provision of refrigeration to a heat load with reduced overall process power consumption than is possible with conventional cascade refrigeration system operation.

SUMMARY OF THE INVENTION

The above and other objects, which will become apparent to those skilled in the art upon a reading of this disclosure, are attained by the present invention one aspect of which is:

A method for operating a cascade refrigeration system comprising:

(A) compressing a first refrigerant in a first compressor, condensing the compressed first refrigerant, expanding the resulting first refrigerant to reduce the pressure and the temperature of the first refrigerant, passing the resulting first refrigerant to a heat exchanger, and vaporizing the resulting first refrigerant in the heat exchanger;

(B) compressing a second refrigerant in a second compressor, passing the compressed second refrigerant to the heat exchanger, condensing the second refrigerant in the heat exchanger by indirect heat exchange with said vaporizing first refrigerant, expanding the resulting second refrigerant to reduce the pressure and the temperature of the second refrigerant, and vaporizing the resulting second refrigerant by absorbing heat from a refrigeration load;

(C) monitoring the inlet and outlet pressure of each of the first compressor and the second compressor, monitoring the power consumption of each of the first compressor and the second compressor, and communicating the monitored pressure and power values to a process controller;

(D) operating the process controller to utilize the communicated pressure and power values to compute more efficient operating pressures for each side of the heat exchanger; and (E) adjusting the operation of the first compressor and the second compressor to adjust the pressures of the first refrigerant and the second refrigerant being passed to the heat exchanger to be closer to the said more efficient operating pressures.

Another aspect of the invention is:

A method for operating a cascade refrigeration system comprising:

(A) compressing a first refrigerant in a first compressor, condensing the compressed first refrigerant, passing the condensed first refrigerant to a first receiver and thereafter expanding the first refrigerant to reduce the pressure and the temperature of the first refrigerant, passing the resulting first refrigerant to a heat exchanger, and vaporizing the resulting first refrigerant in the heat exchanger;

(B) compressing a second refrigerant in a second compressor, passing the compressed second refrigerant to the heat exchanger, condensing the second refrigerant in the heat exchanger by indirect heat exchange with said vaporizing first refrigerant, passing the condensed second refrigerant to a second receiver and thereafter expanding the second refrigerant to reduce the pressure and the temperature of the second refrigerant, and vaporizing the resulting second refrigerant by absorbing heat from a refrigeration load;

(C) monitoring the inlet and outlet pressure of each of the first compressor and the second compressor, monitoring the power consumption of each of the first compressor and the second compressor, and communicating the monitored pressure and power values to a process controller;

(D) operating the process controller to utilize the communicated pressure and power values to compute more efficient operating pressures for each side of the heat exchanger; and (E) adjusting the quantity of the first refrigerant stored in the first receiver and adjusting the quantity of second refrigerant stored in the second receiver so that the operational pressures of the first compressor and the second compressor are closer to the said more efficient operating pressures.

DETAILED DESCRIPTION

Figure 1:
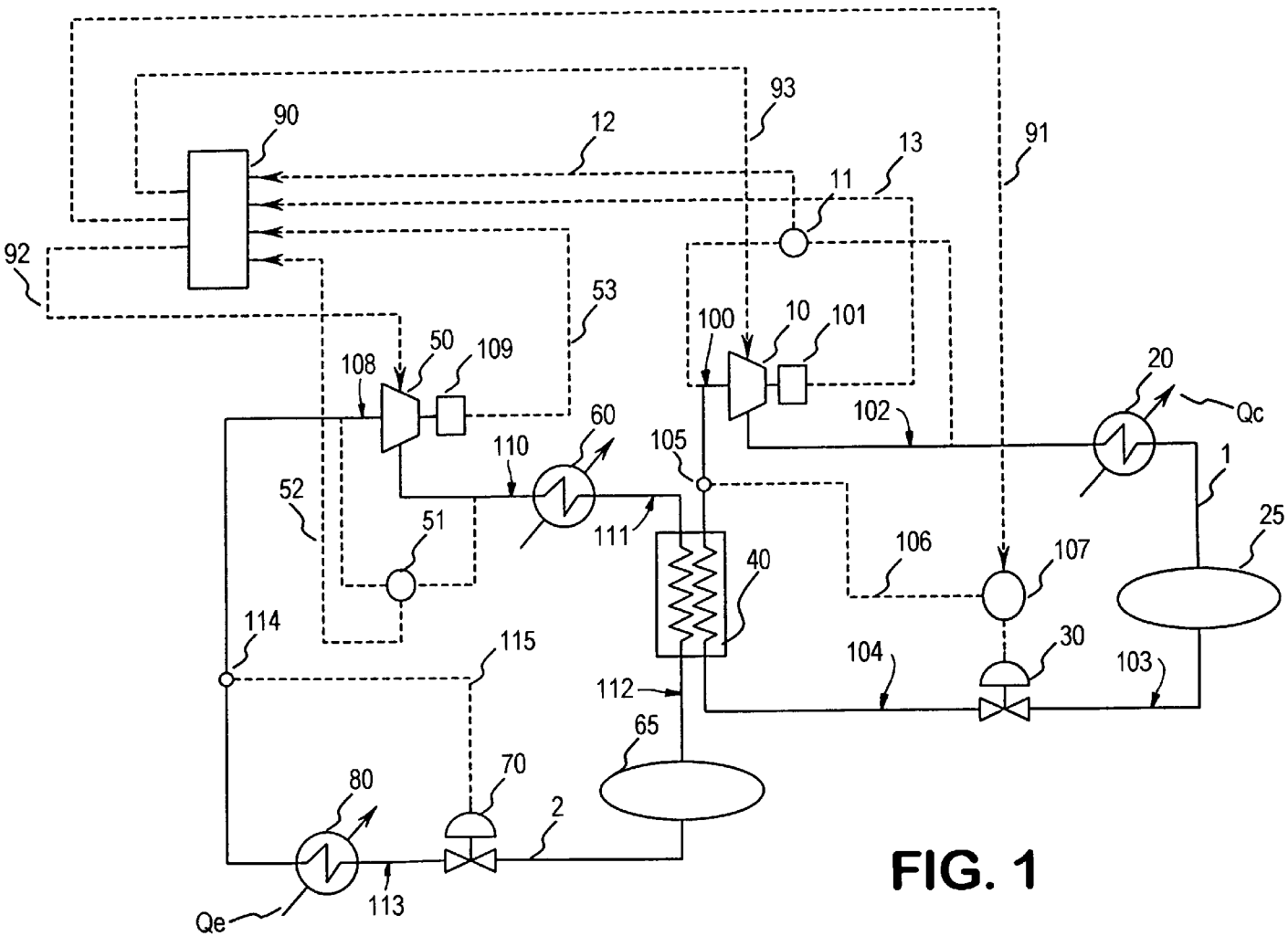
FIG. 1 is a schematic representation of one embodiment of an arrangement which may be used in a preferred practice of this invention.

The invention will be described in detail with reference to the Drawings. Referring now to FIG. 1, first refrigerant 100 is passed to first compressor 10 wherein it is compressed to a pressure generally within the range of from 150 to 300 pounds per square inch absolute (psia). Compressor 10 is powered by external motor 101. The compression of the first refrigerant may be through a single compressor, as shown in FIG. 1, or it may be through more than one compressor. The first refrigerant preferably is ammonia or a mixture which includes ammonia. Other components which may typically comprise some or all of the first refrigerant include $C_2H_2F_4$ (R134a), $CH_3CHF_2$(R152a), $C_3H_8$(R290) and $C_4H_{10}$ (R600a)

The resulting compressed first refrigerant 102 is substantially completely condensed in condenser 20. Condensing energy Qc may be removed by a suitable ambient utility such as cooling water or air. The liquid first refrigerant 1 is then directed to first receiver 25. First receiver 25 is used to provide system capacitance. It can be used to adjust system first refrigerant charge thereby indirectly controlling the operating pressures for the compressors. In addition first receiver 25 may be used to store the entire charge of first refrigerant upon shut down or emergency.

From first receiver 25 the liquified first refrigerant is passed in stream or line 103 to expansion valve 30 wherein it is expanded and the temperature and the pressure of the first refrigerant are substantially reduced. Typically the pressure of the expanded first refrigerant in stream 104 will be within the range of from 14.7 to 50 psia, and the temperature of the expanded first refrigerant in stream 104 will be within the range of from −30 to 22° F.

First refrigerant 104 is then passed to heat exchanger 40, which is the refrigerant-refrigerant evaporator/condenser of the cascade refrigeration system. Heat exchanger 40 may comprise a single module, as is shown in the embodiment of the invention illustrated in FIG. 1, or it may comprise a plurality of modules. The first refrigerant is vaporized within heat exchanger 40 by indirect heat exchange with a second refrigerant as will be more fully described below. Preferably, as shown in FIG. 1, the first refrigerant completely traverses heat exchanger 40 although partial traverse may also be employed in the practice of this invention. The resulting vaporized first refrigerant is passed back to compressor 10 as stream 100 and the first refrigerant circuit begins anew. In a preferred embodiment of the invention as illustrated in FIG. 1, expansion valve 30 can be used to control the level of refrigerant superheat for the vapor exiting heat exchanger 40. This may be accomplished through temperature sensing device 105 and feedback conduit or signal 106 which passes the signal to local controller 107 for expansion valve 30.

Second refrigerant 108 is passed to second compressor 50 wherein it is compressed to a pressure generally within the range of from 200 to 500 psia. Second compressor 50 is powered by external motor 109. The compression of the second refrigerant may be through a single compressor, as shown in FIG. 1, or it may be through more than one compressor. The second refrigerant preferably is carbon dioxide or a mixture which includes carbon dioxide. Other components which may typically comprise some or all of the second refrigerant include $C_2HF_5$, $CH_2F_2$ or $C_3H_8$.

Compressed second refrigerant 110 is passed from compressor 50 to aftercooler 60 wherein it is at least partially desuperheated against cooling fluid, and the compressed second refrigerant is then passed as stream 111 to heat exchanger 40. Within heat exchanger 40 the second refrigerant is condensed by indirect heat exchange with the aforesaid vaporizing first refrigerant which absorbs the heat of condensation from the second refrigerant. After at least partial, preferably complete, traverse of heat exchanger 40, the condensed second refrigerant is passed in line 112 to second receiver 65 and then passed as stream 2 to expansion valve 70 wherein it is flashed, i.e. expanded, to be at a reduced pressure and temperature. Second receiver 65 operates in the same manner with respect to the second refrigerant as was described for first receiver 25 with respect to the first refrigerant. Typically the pressure of the expanded second refrigerant in stream 113 will be within the range of from 70 to 200 psia, and the temperature of the expanded second refrigerant in stream 104 will be within the range of from −72 to 20° F.

The resulting second refrigerant 113 from expansion valve 70 is then vaporized in evaporator or heat exchanger 80 by absorbing heat from external refrigeration load $Q_e$. The refrigeration load may result from any number of sources such as the latent heat required to freeze food, or the energy necessary to maintain food in a frozen state, e.g. food storage. The resulting vaporized second refrigerant is passed back to compressor 50 as stream 108 and the second refrigerant circuit begins anew. As was the case with expansion valve 30, in a preferred embodiment of the invention, expansion valve 70 is used to target a particular level of vapor superheat at the exit of evaporator 80. This is accomplished through temperature sensing device 114 and feedback conduit or signal 115.

The dotted lines in FIG. 1 represent transmission paths for electronic control signals. The inlet and outlet pressures of compressors 10 and 50 are directed to a control means 11 and 51 respectively in order to calculate the instantaneous pressure ratio across each machine. The pressure ratio across each compressor is then transmitted to the primary process controller 90 via signals 12 and 52. Additional control signals 13 and 53 are generated that are representative of the power consumed by each compressor motor 101 and 109, respectively. These control signals are then transmitted to the primary process controller 90.

Within primary process controller 90, the sited individual control signals (12, 13, 52, 53) are used to generate/calculate optimal process setpoints denoted by electronic signals 92 and 93. Such signals representing the new operational setpoints for compressors 10 and 50. Such setpoints may be used to specify bypass, guide vane position, speed, slide valve position and the like. Alternatively, such signals may be directed to receivers 25 and 65 to adjust the quantity of stored first and second refrigerant respectively and thereby adjusting the operating pressure of the system. This approach is particularly useful with positive displacement type compressors. The nature of such setpoints depending upon the type of compressor employed. Additional temperature setpoint(s) 91 may be generated for purposes of adjusting the temperature setpoint and local controller 107 for expansion valve 30. The essential aspect of the subject invention entails the use of the individual pressures or pressure ratios existing at the inlet and outlet of each compressor and the corresponding power consumed by each compressor.

The following example illustrates a possible calculation by which process controller 90 might utilize the sited process signals/inputs. It should be noted that the following example is only a representative calculation and is not the only technique by which the sited observables can be used to control the process.

Several physical parameters have proven useful to the operation of controller means 90. The ratio of heat capacity ($k=C_p/C_v$) for both the primary and secondary refrigerants is useful in calculating optimal compression ratios. For many gases, k may be assumed constant over a broad range of conditions. A particularly useful form is found within the pressure ratio exponent associated with the formula for adiabatic compression power.

$$\gamma = \frac{k-1}{k} \tag{1}$$

Through the use of equation (1), calculation of the new optimal pressure ratio is possible. The following equations can be obtained through identifying the conditions existing at the point of minimum process power consumption.

In order to maintain consistency with FIG. 1, subscripts 1 and 2 refer to the primary and secondary refrigeration circuits respectively. Pr and hp represent compression ratio and power consumption (horsepower). Equation 2 provides an explicit solution to the new optimal pressure ratio for the primary or first circuit.

$$Pr_1 = \left[\frac{\theta}{\theta - 1}\right]^{1/\gamma_1} \tag{2}$$

Where θ is defined by the following relation.

$$\theta = \beta\left[\frac{\gamma_2}{\gamma_1}\right]\left[\frac{Pr_2^{\gamma_2}}{Pr_2^{\gamma_2} - 1}\right]\left[\frac{hp_2}{hp_1}\right] \tag{3}$$

Inspection of the non-dimensional parameter θ indicates the use of a single non-dimensional tuning parameter β. The value of β may be obtained in a number of ways. Parameter β may be assigned a value of unity (1.0). More preferably, β may be empirically adjusted to match a known design point optimum (or a point of most probable operation). Alternatively, β may be defined from knowledge of the vapor pressure curves for each refrigerant (as shown below).

It is well established that the saturated vapor pressure curve for most compounds may be fitted to the integrated form of the Clapeyron Equation. Note that A and B are constants depending solely on the nature of the subject fluid and the range from which their values were regressed.

$$\ln P_{sat} = A - \frac{B}{T} \tag{4}$$

In a cascade refrigeration system utilizing two refrigerants, the conditions for optimality may be readily derived through the use of the above vapor pressure-temperature relation. In this approach the theoretical value of β is the ratio of temperature dependent terms from equation (4).

$$\beta = \frac{B_2}{B_1} \tag{5}$$

Figure 2:
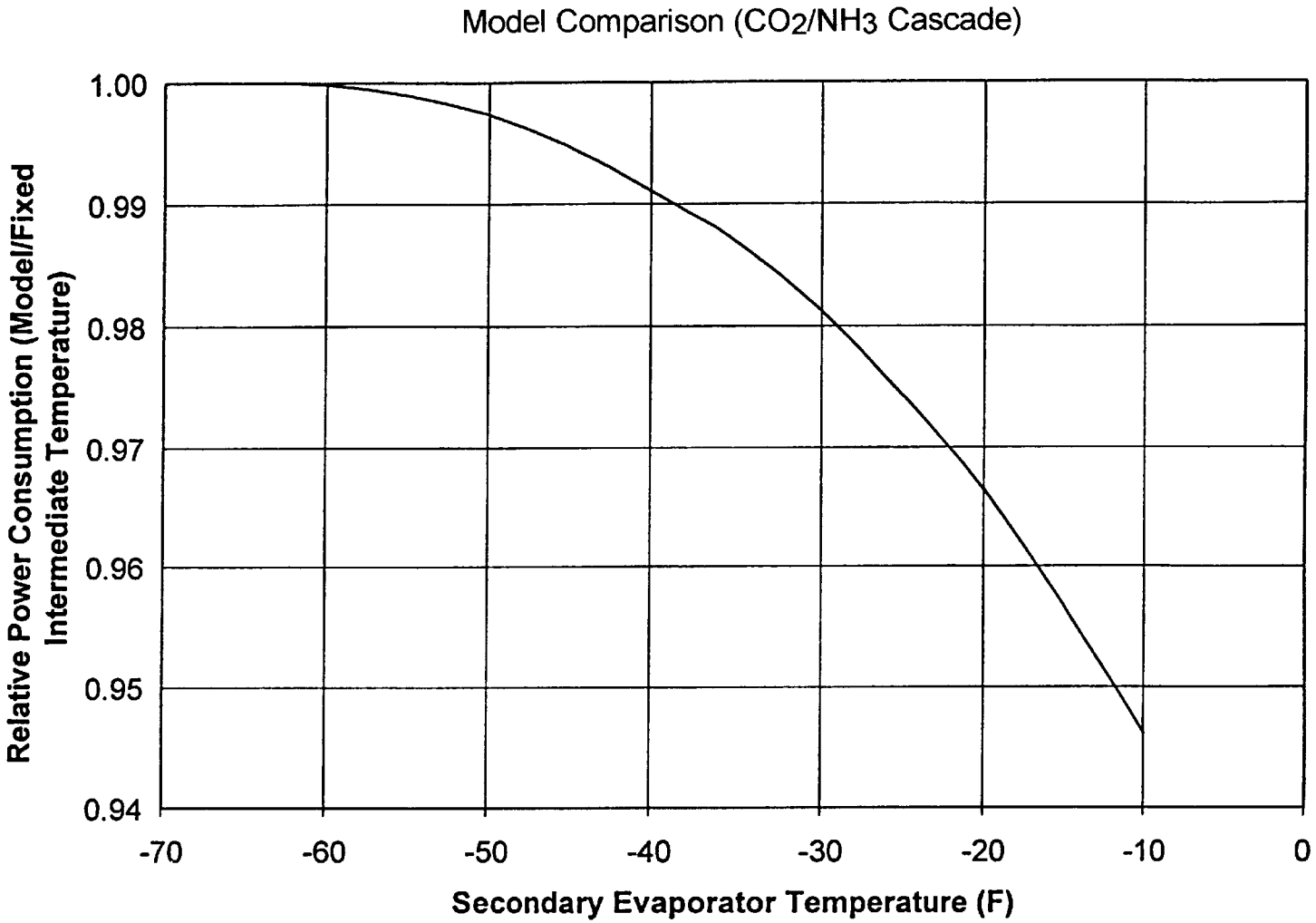
FIG. 2 is a graphical representation of power consumption versus secondary evaporator temperature for a carbon dioxide/ammonia cascade system.

FIG. 2 illustrates the efficacy of equation 2. FIG. 2 was generated for a $CO_2/NH_3$ cascade system in which each refrigerant circuit employs a single stage of compression. The value of β was assumed constant and was empirically tuned to match the rigorous optimum observed for a $CO_2$ evaporator temperature of −65° F. and $NH_3$ condenser of 100° F. Inspection of FIG. 2 indicates that the use of the subject approach results in up to a 5% power savings relative to a constant interstage temperature. Relative to the rigorous locus of optimal interstage temperatures (pressure ratios), the subject model exhibits power penalties of <0.3%.

Figure 3:
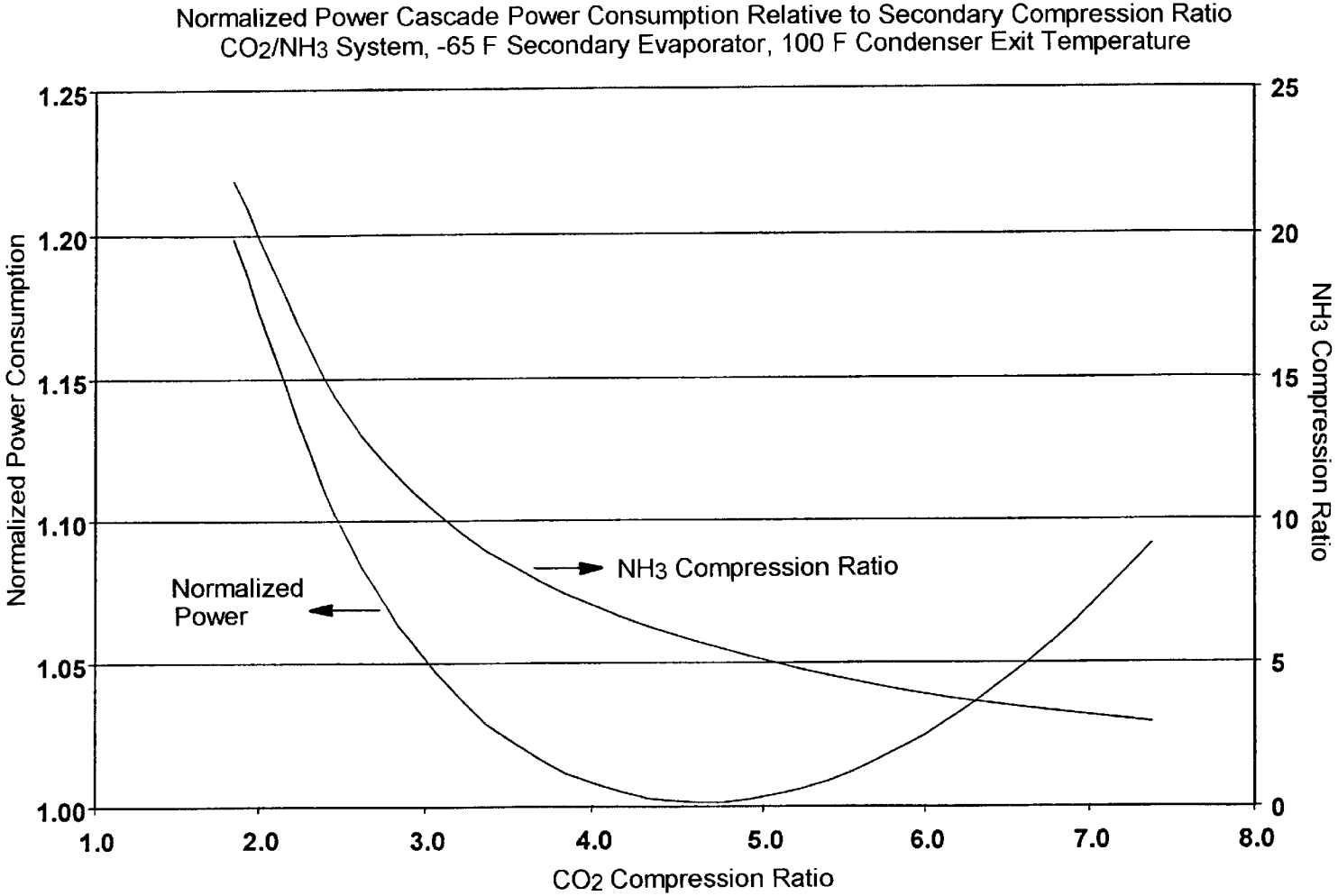
FIG. 3 is a graphical representation illustrating the effect of compression ratio upon cascade system power consumption.

FIG. 3 illustrates the effect of compression ratio upon cascade system power consumption. The normalized cycle power was computed by dividing actual power by the power consumed at an optimal interstage temperature/pressure. The plot was generated assuming a constant compressor efficiency and a $CO_2$ evaporator and $NH_3$ condenser of temperatures of −65° F. and 100° F., respectively. The interstage condenser (exchanger 40) minimum approach was 5° F. FIG. 3 indicates that unit power can be reduced by 5–10% through optimization of pressure ratio.

The practice of the invention involves ascertaining the operating pressures near the inlet and outlet of each compressor, and also ascertaining the power consumed by each compressor. By ascertaining, it is meant any method of obtaining, calculating or inferring the subject quantities. As an example, process pressures can be inferred from knowledge of the saturation temperature via equation (4). Likewise, power consumption can be computed directly from voltage and current of the corresponding motor or it may be calculated given the pressures (and other physical parameters, flow, heat capacity, etc.), the former being more useful to the subject approach since it accounts for the actual compression and mechanical efficiency. The compressor flow may also be ascertained from knowledge of the refrigeration load ($Q_e$). Such inferential information (T, $Q_e$, F, Cp, etc.) may be communicated directly to controller 90 in lieu of the cited pressure(s)/ratio(s) and motor(s) power.

The approach outlined in the example can be easily generalized to the use of multiple parallel or series compression arrangements. In some situations it will be desirable to evaporate the second refrigerant at a number of different pressures/temperatures. Equation 2 can be extended to account for multiple parallel compression to a common discharge or condensation pressure. Equation (3) can be further generalized for parallel secondary compressors.

$$\theta = \frac{\beta \sum_i \left[\frac{\gamma_{2i} Pr_{2i}^{\gamma_{2i}}}{Pr_{2i}^{\gamma_{2i}} - 1}\right] hp_{2i}}{\gamma_1 hp_1} \tag{6}$$

A similar approach can be used for parallel compressors in the first refrigerant circuit. Alternatively, the equations can be rearranged and used to generate an objective function that is minimized by the individual process controllers. Process control means 90 may comprise a pre-programmed logic controller or a stand-alone computer with suitable algorithms for continuous control. Signals to and from the controller are preferably electrical signals, however it is known that such signals can be conveyed pneumatically or otherwise.

Compressors 10 and 50 may be virtually any type of compressor capable of capacity and pressure control. These include oil-flooded screw compressors, reciprocating or centrifugal compressors. Compressors signals from controller 90 may manipulate slide valve position, speed or guide vanes, respectively. Valves 30 and 70 may be of several types including but not limited to thermo-static valves and electrically driven control valves. Such valves can be equipped with local control logic like that shown in FIG. 1. In this situation the control valve responds to setpoint-signal 91 from process controller 90. Alternatively, each cycle may employ evaporator back-pressure control (in which case control valves would be located between the evaporator and the compressor inlet).

In reference to FIG. 1, there are a number of process variations that can be incorporated into the basic cascade refrigeration flowsheet. Some of the options include the use of a suction super-heater located before secondary compressor 50, as well as additional after-coolers and oil coolers that may form part of compressors 10 and 50. If multiple stages of compression are used for either loop, economizer type phase separators may be used to direct vapor to inter-stage compression. Likewise, some compressors (e.g. oil flooded screw compressors) may be able to accommodate economizer flash gas stream directly. Depending upon the type of compressors used, the compressor packages may incorporate several stages of oil removal equipment. Individual process control of unit operations may be performed using conventional PID control or through the use of model predictive control. The highlighted approach is applicable to either scenario, again the critical element of the subject invention being the use of the compression pressures and power consumption.

What is claimed is:

1. A method for operating a cascade refrigeration system comprising:

(A) compressing a first refrigerant in a first compressor, condensing the compressed first refrigerant, expanding the resulting first refrigerant to reduce the pressure and the temperature of the first refrigerant, passing the resulting first refrigerant to a heat exchanger, and vaporizing the resulting first refrigerant in the heat exchanger;

(B) compressing a second refrigerant in a second compressor, passing the compressed second refrigerant to the heat exchanger, condensing the second refrigerant in the heat exchanger by indirect heat exchange with said vaporizing first refrigerant, expanding the resulting second refrigerant to reduce the pressure and the temperature of the second refrigerant, and vaporizing the resulting second refrigerant by absorbing heat from a refrigeration load;

(C) monitoring the inlet and outlet pressure of each of the first compressor and the second compressor, monitoring the power consumption of each of the first compressor and the second compressor, and communicating the monitored pressure and power values to a process controller;

(D) operating the process controller to utilize the communicated pressure and power values to compute more efficient operating pressures for each side of the heat exchanger; and (E) adjusting the operation of the first compressor and the second compressor to adjust the pressures of the first refrigerant and the second refrigerant being passed to the heat exchanger to be closer to the said more efficient operating pressures.

2. The method of claim 1 wherein the first refrigerant comprises ammonia.

3. The method of claim 1 wherein the second refrigerant comprises carbon dioxide.

4. The method of claim 1 wherein the temperature of the expanded first refrigerant is within the range of from −30 to 22° F.

5. The method of claim 1 wherein the temperature of the expanded second refrigerant is within the range of from −72 to −20° F.

6. The method of claim 1 wherein the monitored inlet and outlet pressure values are communicated to the process controller as pressure ratios.

7. The method of claim 1 wherein the refrigeration load comprises the freezing of food.

8. The method of claim 1 wherein the refrigeration load comprises the maintaining of food in a frozen state.

9. A method for operating a cascade refrigeration system comprising:

(A) compressing a first refrigerant in a first compressor, condensing the compressed first refrigerant, passing the condensed first refrigerant to a first receiver and thereafter expanding the first refrigerant to reduce the pressure and the temperature of the first refrigerant, passing the resulting first refrigerant to a heat exchanger, and vaporizing the resulting first refrigerant in the heat exchanger;

(B) compressing a second refrigerant in a second compressor, passing the compressed second refrigerant to the heat exchanger, condensing the second refrigerant in the heat exchanger by indirect heat exchange with said vaporizing first refrigerant, passing the condensed second refrigerant to a second receiver and thereafter expanding the second refrigerant to reduce the pressure and the temperature of the second refrigerant, and vaporizing the resulting second refrigerant by absorbing heat from a refrigeration load;

(C) monitoring the inlet and outlet pressure of each of the first compressor and the second compressor, monitoring the power consumption of each of the first compressor and the second compressor, and communicating the monitored pressure and power values to a process controller;

(D) operating the process controller to utilize the communicated pressure and power values to compute more efficient operating pressures for each side of the heat exchanger; and (E) adjusting the quantity of the first refrigerant stored in the first receiver and adjusting the quantity of second refrigerant stored in the second receiver so that the operational pressures of the first compressor and the second compressor are closer to the said more efficient operating pressures.

10. The method of claim 9 wherein the first refrigerant comprises ammonia.

11. The method of claim 9 wherein the second refrigerant comprises carbon dioxide.

12. The method of claim 9 wherein the temperature of the expanded first refrigerant is within the range of from −30 to 22° F.

13. The method of claim 9 wherein the temperature of the expanded second refrigerant is within the range of from −72 to −20° F.

14. The method of claim 9 wherein the refrigeration load comprises the freezing of food.

15. The method of claim 9 wherein the refrigeration load comprises the maintaining of food in a frozen state.

* * * * *